US006508186B2

(12) United States Patent
Veh

(10) Patent No.: US 6,508,186 B2
(45) Date of Patent: Jan. 21, 2003

(54) QUICK RELEASE LOCKING DEVICE FOR A STRAP

(75) Inventor: Peter Karl Veh, Lindau-Bodensee (DE)

(73) Assignee: Neil Pryde Limited, Hong Kong ( * ) Notice: Subject to any disclaimer, the term of this patent is extended or adjusted under 35 U.S.C. 154(b) by 0 days.

(21) Appl. No.: 10/037,918

(22) Filed: Oct. 19, 2001

(65) Prior Publication Data

US 2002/0088386 A1 Jul. 11, 2002

(30) Foreign Application Priority Data

Jan. 11, 2001 (DE) ..... 201 00 469 U

(51) Int. Cl.[7] ..... B63B 35/79
(52) U.S. Cl. ..... 114/39.18
(58) Field of Search ..... 24/170, 191, 164, 24/69 TS, 68 E, 68 T; 182/3; 114/39.18

(56) References Cited

U.S. PATENT DOCUMENTS

| | | | | |
|---|---|---|---|---|
| 4,112,865 A | | 9/1978 | Carn | |
| 4,873,934 A | | 10/1989 | Renault | |
| 4,934,297 A | | 6/1990 | Long | |
| 4,999,846 A | | 3/1991 | Ball et al. | |
| 5,074,011 A | * | 12/1991 | Carlson | 24/170 |
| 5,195,443 A | | 3/1993 | Williams | |
| 5,642,555 A | * | 7/1997 | Lin | 24/68 SK |
| 5,745,959 A | * | 5/1998 | Dodge | 24/68 SK |
| 5,852,852 A | * | 12/1998 | Rigal | 24/170 |
| 6,293,215 B1 | * | 9/2001 | Moorrees | 114/39.18 |

FOREIGN PATENT DOCUMENTS

| | | | |
|---|---|---|---|
| DE | 3216704 A1 | | 11/1983 |
| DE | 3229147 A1 | | 2/1984 |
| DE | 8404269 | | 5/1984 |
| DE | 3445393 | | 6/1986 |
| DE | 29711757 U1 | * | 11/1997 |
| DE | 19800757 | | 9/1999 |
| GB | 2115684 A | | 9/1983 |

OTHER PUBLICATIONS

Nov./Dec. 1993, Surf Magazine.

* cited by examiner

*Primary Examiner*—Stephen Avila
(74) *Attorney, Agent, or Firm*—Jackson Walker L.L.P.

(57) ABSTRACT

A locking device for a hooked spreader bar includes first and second locking members. The locking member has a shaped nose to fit serrations in a strap to prevent longitudinal movement of the strap. To release the strap the second member is rotated clockwise so that initially a surface lifts away from a side of the nose, Thereafter further rotation of the second member abuts the first member and causes the first member to rotate (clockwise) and lift the nose away from the serrations. During closing of the locking device, the first member is rotated anti-clockwise and pushes against and rotates the second member, which is fully closed by downward manual pressure on its top surface.

9 Claims, 2 Drawing Sheets

QUICK RELEASE LOCKING DEVICE FOR A STRAP

FIELD OF THE INVENTION

The invention relates to a quick release locking device for a strap.

BACKGROUND OF THE INVENTION

The invention relates in particular to such a locking device for a general planar strap having a serrated surface for engagement for the locking device. Commonly such strap are used on sailor's harness, foot straps for snowboards, chinstraps for headgear and various other apparel and equipment. Basically, the strap is offered up to the locking device that is anchored to the equipment at one side and serves to tighten or close the equipment to a user. The locking device is then closed to engage a suitable one or more of the serration and hold the strap fast. When required the locking device can be quickly released to un-thread the strap from the locking device.

The invention has especial application to a sailing harness having a hooked spreader bar for attachment to a boom of a windsurfer or a trapeze line of a sailboat rigging. Such an attachment allows the sailor to use his body weight and release his hands for other tasks or simply to relieve, from time to time, the effort required to hold the boom or the trapeze line. Hooked spreader bars are already known and are attachable to a sailor's body harness by webbing straps provided for each end of the spreader bar. Such attachment requires threading of the straps into buckles. This normally takes some time, requires both hands and is not be quickly releasable. Also, inherent loose strap ends can be quite hazardous, especially in high winds where the loose ends flap violently about. Buckled straps tend to loosen in time requiring the sailor to make continuous adjustments in use.

In German Utility Model Patent No. 29711757.2, a suitable locking mechanism was proposed.

SUMMARY OF THE INVENTION

An object of invention is to provide a spreader bar or similar arrangement having a strap with a serrated end with an improved locking mechanism.

According to a first aspect the invention provides for a locking device for securing apparel or equipment having a strap with a serrated remote end threaded into and located in an anchor body, and locking means mounted to the anchor body arranged to lock and hold the strap longitudinally adjacent respective end of the body, wherein each locking means comprises first and second pivotable locking members mounted adjacent the end of the body and adjacent one another above the strap to rotate about respective axes lateral to the longitudinal axis of the strap, the first locking member having a shaped nose for engaging the serrations to lock the strap against longitudinal movement, and the second locking member having a surface that urges against the nose of the second locking member to lock the nose against the strap, in which initial pivotable rotation of the first locking member from its locking position causes the surface to lift away the nose to allow the strap to be released and, on further rotation of the second member, the second member abuts the first member to rotate the first member so as to lift the nose away from the serrations.

According to a second aspect the invention provides for a sailor's support apparatus having a locking device for securing same, the locking device having a strap with a serrated remote end threaded into and located in an anchor body, and a lock mounted to the anchor body arranged to lock and hold the strap longitudinally adjacent respective end of the body, wherein each lock comprises first and second pivotable locking members mounted adjacent the end of the body and adjacent one another above the strap to rotate about respective axes lateral to the longitudinal axis of the strap, the first locking member having a shaped nose for engaging the serrations to lock the strap against longitudinal movement, and the second locking member having a surface that urges against the nose of the second locking member to lock the nose against the strap, in which initial pivotable rotation of the first locking member from its locking position causes the surface to lift away the nose to allow the strap to be released and, on further rotation of the second member, the second member abuts the first member to rotate the first member so as to lift the nose away from the serrations. The body may comprise a hooked spreader bar and the strap extends at least partially around the sailor's body.

Preferably, the locking members are spring-biased towards their locking positions.

Preferably, the first member and second member have upstanding curved surface handles that lie together to form a generally continuous surface over the end of the anchor body when the locking device is locked.

Preferably, the first member is arranged to abut against the second member when the first member is rotated, from an open position, to rotate the second member towards the locked position.

BRIEF DESCRIPTION OF THE DRAWINGS

A locking device for a sailor's support apparatus according to the invention will now be described by way of example with reference to the accompanying drawings in which.

DESCRIPTION OF THE PREFERRED EMBODIMENT

Figure 1:
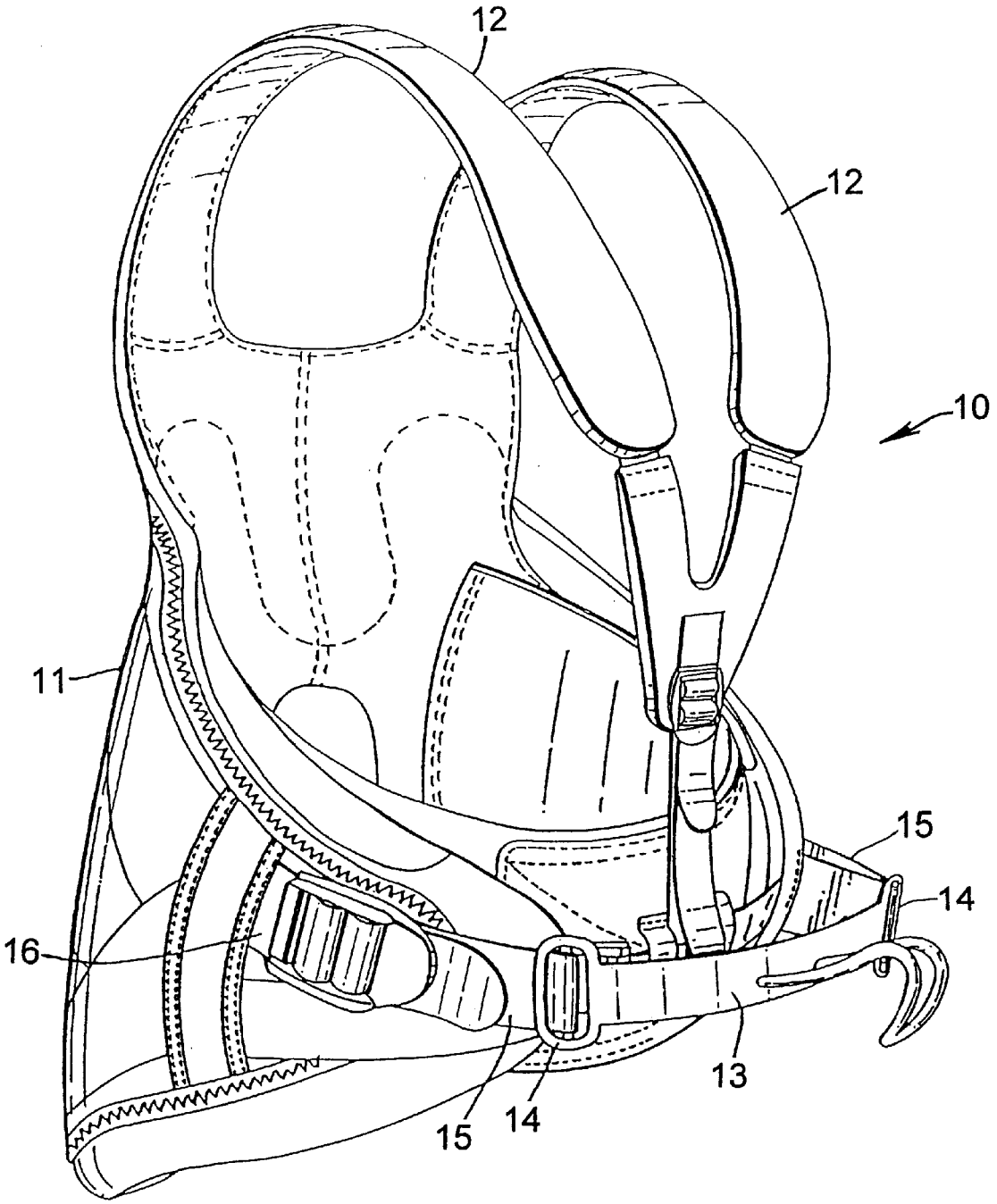
Fig.1 (PRIOR ART)
FIG. 1 is an isometric view of a prior art arrangement.

Referring to the drawings, in FIG. 1 a sailor's support apparatus comprises a comprehensive harness 10 which in use adjustably fits to a sailor's upper torso having a back support 11 and shoulder straps 12. A hooked spreader bar 13 has a buckle 14 at each end and is provided with straps 15 that are buckled to straps 16 that are anchored to the harness 10. The spreader bar 13 is attached after the harness is fitted to the sailor by threading and tightening the straps 15 in conventional manner.

Figure 2:
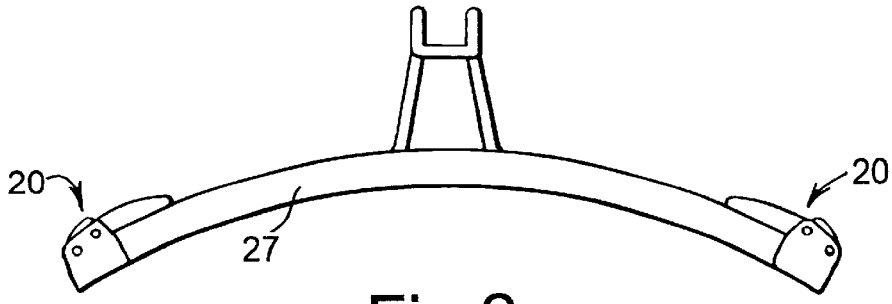
FIG. 2 is a side view of a spreader bar for use with a locking device apparatus of the present invention.
Figure 3:
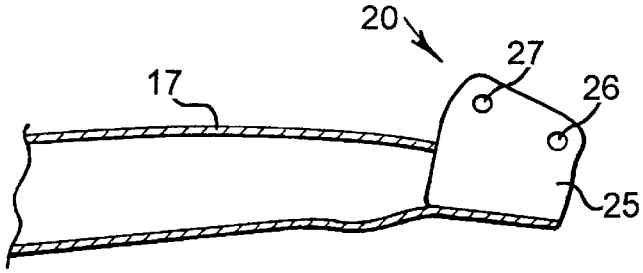
FIG. 3 is a sectional side view of an end of the spreader bar of FIG. 2.
Figure 4:
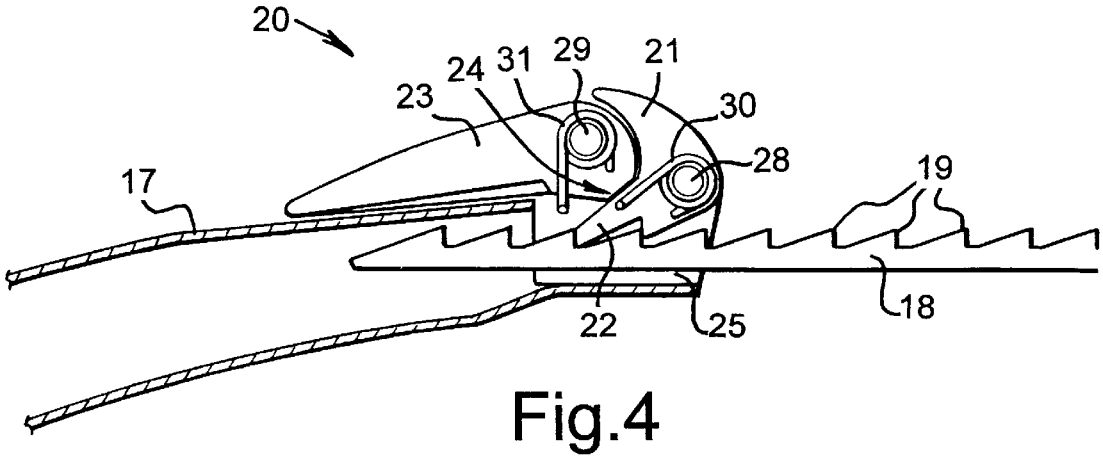
FIG. 4 is a sectional side view of the spreader bar with a locking device fitted to the spreader bar.
Figure 5:
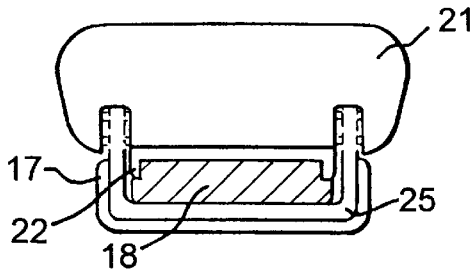
FIG. 5 is an end view of the locking device.

In FIG. 2, a hooked spreader bar 17 (which provides an anchor body for the locking device) is formed of a hollow curved tube having a cross-section that is generally circular at its centre and rectangular at each end where it is dimensioned to receive ends of elongate straps 18 (see FIG. 4). The outer (or upper, as seen in FIG. 4) surfaces of the straps 18 are formed with serrations 19 and a locking device 20 is mounted at each end of the spreader bar 17

As shown in FIG. 4, each locking device 20 has a first locking member 21 with a shaped nose 22 that can mechanically engage the serrations 19. A second locking member 23 has a planer surface 24 that urges against and presses down on one side of the nose 22 as shown in FIG. 4.

A U-shaped bracket 25 mounted to the end of the spreader bar 17 has pairs of holes 26 and 27 that are used for supporting two axles 28 and 29. The axle 28 supports the first locking member 21 and the axle 29 supports the second locking member 23 for rotation about axes that are transverse to the longitudinal axis of the strap 18. Springs 30 and 31 bias the locking members towards their locking positions.

The spreader bar 17 is fitted by pushing the ends of the straps 18 into respective ends of the spreader bar 17 until the spreader bar 17 is held against the sailor's body. At this point, each locking mechanism 20 is closed to lock respective serrations 19 of the straps 18. The straps will then be held longitudinally and will need no further adjustment. If the sailor wishes to loosen or remove the straps 18 from the spreader bar 17, the locking device 20 can be quickly released, as explained below.

Embodiments of this invention enable a sailor to loosen or tighten the strap single-handedly. In FIG. 4, the strap is locked in position in the spreader bar. In order to tighten the strap, the locking member 23 is pulled up (i.e. rotated clockwise) towards a vertical position in the Figure. As a result and initially, the surface 24 moves away from the side of the nose 22. As the locking member 23 is further rotated, it abuts the locking member 21 to rotate the locking member 21 against the bias of the spring 30, and the nose 22 will be lifted away from the strap to allow the strap to move longitudinally in the spreader bar. The strap can be adjusted to the desired position.

When the locking member 23 is let go, the spring 31 rotates the member 23 anti-clockwise to allow the spring 30 to rotate the locking member 21 anti-clockwise. As a result the nose 22 is pushed against one of the serrations 19 to hold the strap firmly in the spreader bar and thereafter prevent relative longitudinal movement of the strap. Single-handed downward pressure on the locking member 23 further rotates the locking member 23, in the anti-clockwise direction, causing the locking member 23 to abut against the locking member 21 and lock the locking member 21 in its closed or locking position, shown in FIG. 4.

It will be appreciated that not only can release or locking of the strap in the spreader bar be carried out single-handedly but is done using one (directional) "sweeping" movement of the hand over and against the locking member 23. Such movement is, in FIG. 4, to the right to release the strap and to the left to lock the strap. This is an important feature of the described embodiment and enables single directional hand movements for each operation of the locking device to significantly simplify such tasks.

Also, as the locking member 21 does not need to be manually operated, its shape does not need to include a handle or gripping part; this simplifies its construction and allows the locking member 21 to be externally streamlined or aerodynamic, say.

It will be noted in this latter respect, especially as seen in FIG. 4, that the locking members 21 and 23 have upstanding curved surfaces which lie together when the locking device is closed to form a generally continuous surface over a respective end of the spreader bar. As such, when the locking device is fully closed, the upstanding locking device surfaces fit snugly against or towards the sailor's body. The locking device is thus tucked in towards the sailor's body and the locking member 23 is inherently unlikely to be lifted, or the locking device inadvertently released, during normal use.

Normally, the locking devices are fitted to a comprehensive harness but could be simply fitted the described spreader bar with the quick-release locking device at each end and a single strap, or simple harness, which is attachable or held to, say, a life jacket for example.

Whereas the locking devices have been described with reference to a sailor's harness, the same locking devices can be used on a wide variety of apparel or equipment, including snow boards (where the anchor body is riveted to a foot strap) and headgear, in which a serrated closure strap end is provided. The locking devices have particular application for sports equipment and protective apparel or headgear where the user requires to tighten the strap and lock the end of the strap, or quickly release the strap, using only one hand, for convenience or necessity. Furthermore, because the locking device fits generally flush against or towards the strap when it is locked, or has no generally upstanding protruding parts, it is unlikely that the locking device will released inadvertently during normal use.

What is claimed is:

1. A locking device for securing apparel or equipment having a strap with a serrated remote end threaded into and located in an anchor body, and locking means mounted to the anchor body arranged to lock and hold the strap longitudinally adjacent respective end of the body, wherein each locking means comprises first and second pivotable locking members mounted adjacent the end of the body and adjacent one another above the strap to rotate about respective axes lateral to the longitudinal axis of the strap, the first locking member having a shaped nose for engaging the serrations to lock the strap against longitudinal movement, and the second locking member having a surface that urges against the nose of the second locking member to lock the nose against the strap, in which initial pivotable rotation of the first locking member from its locking position causes the surface to lift away the nose to allow the strap to be released and, on further rotation of the second member, the second member abuts the first member to rotate the first member so as to lift the nose away from the serrations.

2. A locking device according to claim 1 wherein the locking members are spring-biased towards their locking positions.

3. A locking device according to claim 1 wherein the first member and second member have upstanding curved surface handles that lie together to form a generally continuous surface over the end of the anchor body when the locking device is locked.

4. A locking device according to claims 1 wherein the first member is arranged to abut against the second member when the first member is rotated, from an open position, to rotate the second member towards the locked position.

5. A sailor's support apparatus having a locking device for securing same, the locking device having a strap with a serrated remote end threaded into and located in an anchor body, and a lock mounted to the anchor body arranged to lock and hold the strap longitudinally adjacent respective end of the body, wherein each lock comprises first and second pivotable locking members mounted adjacent the end of the body and adjacent one another above the strap to rotate about respective axes lateral to the longitudinal axis of the strap, the first locking member having a shaped nose for engaging the serrations to lock the strap against longitudinal movement, and the second locking member having a surface that urges against the nose of the second locking member to lock the nose against the strap, in which initial pivotable rotation of the first locking member from its locking position causes the surface to lift away the nose to allow the strap to be released and, on further rotation of the second member, the second member abuts the first member to rotate the first member so as to lift the nose away from the serrations.

6. A locking device according to claim 5 wherein the locking members are spring-biased towards their locking positions.

7. A locking device according to claim 5 wherein the first member and second member have upstanding curved surface handles that lie together to form a generally continuous surface over the end of the anchor body when the locking device is locked.

8. A locking device according to claim 5 wherein the first member is arranged to abut against the second member when the first member is rotated, from an open position, to rotate the second member towards the locked position.

9. A locking device according to claim 5 wherein the body comprises a hooked spreader bar and the strap extends at least partially around the sailor's body.

* * * * *